US006412708B1

(12) United States Patent
Böhringer

(10) Patent No.: US 6,412,708 B1
(45) Date of Patent: Jul. 2, 2002

(54) NOZZLE DEVICE, PREFERABLY ARRANGED IN SANITARY WATER BASINS, CONTAINERS OR THE LIKE

(75) Inventor: Werner Böhringer, Gemmingen (DE)

(73) Assignee: Mabo Steuerungselemente Vertriebs-GmbH, Gemmingen (DE)

( * ) Notice: Subject to any disclaimer, the term of this patent is extended or adjusted under 35 U.S.C. 154(b) by 0 days.

(21) Appl. No.: 09/739,125

(22) Filed: Dec. 18, 2000

(30) Foreign Application Priority Data

Feb. 29, 2000 (DE) ..... 100 09 573

(51) Int. Cl.[7] ..... B05B 7/12

(52) U.S. Cl. ..... 239/413; 239/66; 239/67; 239/407; 239/419; 239/422; 239/426; 239/428; 239/434

(58) Field of Search ..... 239/398, 407, 239/413, 418, 419, 422, 426, 428, 429, 423, 428.5, 433, 434, 61, 66, 67; 4/541.1, 541.3, 541.6, 542

(56) References Cited

U.S. PATENT DOCUMENTS

| | | | | | |
|---|---|---|---|---|---|
| 4,502,168 | A | * | 3/1985 | Jaworski | 239/428.5 X |
| 4,537,358 | A | * | 8/1985 | Anderson | 239/413 |
| 5,014,372 | A | * | 5/1991 | Thrasher et al. | 4/542 |
| 5,142,714 | A | * | 9/1992 | Klotzbach | 4/542 |
| 5,226,601 | A | * | 7/1993 | Hinojosa, Jr. et al. | 239/423 |
| 5,495,627 | A | * | 3/1996 | Leaverton et al. | 239/428.5 X |

FOREIGN PATENT DOCUMENTS

| | | |
|---|---|---|
| DE | 9205316.5 | 6/1992 |
| DE | 19653791 A1 | 6/1998 |
| EP | 0115603 | 10/1987 |

* cited by examiner

*Primary Examiner*—Steven J. Ganey
(74) *Attorney, Agent, or Firm*—Darby & Darby

(57) ABSTRACT

A nozzle device including a nozzle body, a central jet channel which has a first fluid admitted to it, an opening region which widens conically in the jet direction and from which the central jet channel extends, and another channel which opens out into the central jet channel and with which a second fluid can be fed to the first fluid.

11 Claims, 3 Drawing Sheets

NOZZLE DEVICE, PREFERABLY ARRANGED IN SANITARY WATER BASINS, CONTAINERS OR THE LIKE

TECHNICAL FIELD

The present invention relates to a nozzle device, preferably arranged in sanitary water basins, containers or the like, for massaging and/or cleaning purposes, having a nozzle body, a central jet channel, which has a first fluid admitted to it, an opening region, which widens, in particular, conically in the jet direction and from which a jet channel extends, and a further channel, which opens out into the jet channel and via which a second fluid can be fed to the first fluid.

PRIOR ART

Such nozzle devices are used in large numbers today, for example in jacuzzis. In this case, air and/or water are/is pumped through the nozzle device, this achieving a pleasant effervescent massage action for the bather. Such nozzles may also be used for cleaning purposes.

DE 196 53 791 A1 discloses a nozzle device which has an adapter unit and can thus be inserted without difficulty following the installation of the sanitary basins. This reliably avoids scratching or damage during the construction phase.

EP 0 115 603 A1 describes a jacuzzi tub in which the jet discharged from the nozzle device can be pulsed. A normal water jet and a water jet mixed with air emerges in dependence on the pulse frequency. The jet discharged by the nozzle device is always in the same direction. German Utility Model 92 05 316 describes a massage-nozzle device which is intended for sanitary facilities and in which the direction of the discharged jet can be changed. Mechanical means are used for this purpose, as a result of which high outlay is necessary in order to ensure reliable sealing.

DESCRIPTION OF THE INVENTION

Taking the abovementioned prior art as departure point, the technical problem or the object of the present invention is to specify a nozzle device which can be produced cost-effectively and, using straightforward means, makes it possible for the change in direction of the jet discharged by the nozzle device to be realized efficiently and on a permanent basis.

Accordingly, the nozzle device according to the invention is given by the features of independent claim 1. Advantageous configurations and developments form the subject matter of the dependent claims.

Accordingly, the nozzle device according to the invention is distinguished in that n channels are provided for the second fluid, where $n \geqq 2$ (n is greater than or equal to 2), the channels open out into the jet channel in the transition region between the jet channel and the conical opening region, the respective opening regions of the channels open out into the jet channel in a manner in which they are offset circumferentially through 360°/n (degrees), in each case one constricting unit is arranged directly upstream, as seen in the jet direction, of the region in which the channels open out into the jet channel, the channels are designed such that they can be opened and closed in each case via an actuating element, in particular a valve unit, and there is provided a control device which activates the actuating elements or valve units such that they open and close alternately or one after the other in circular sequence or in accordance with a predeterminable rhythm.

By virtue of the two mutually opposite constricting units, which act as break-away edges, there is an increase in the flow speed between the two units. The resulting negative pressure downstream of the constricting units causes the second fluid to be drawn into the central jet via the channels. Depending on which valve has just been opened, the central water jet is thus deflected in terms of direction and positions itself against the wall region extending from the conical opening region and located opposite the opening region of the respective channel.

A particularly preferred configuration of the nozzle device according to the invention is distinguished in that the conical opening region is designed as a component which can be installed in a releasable manner, with the result that it is possible to achieve variable opening angles. According to a preferred embodiment, it is likewise possible for the constricting unit to be designed as an orifice plate which can be installed in a releasable manner, with the result that it is possible to realize a variable jet elongation or a variable opening angle within which the water jet oscillates.

The proposed design ensures that the emerging jet is always positioned alternately against the respectively opposite opening contour and thus produces a permanently reliable diffusing action. There is no need for any moveable components within the nozzle device, with the result that a long service life is achieved. At the same time, the straightforward design outlay is accompanied by a cost-effective production since no moveable components have to be installed. Similarly, there is no need for any extensive seals to be installed.

According to a particularly preferred configuration, the constricting unit is designed as an insert plate.

Alternatively, in a further advantageous configuration, the constricting unit may be part of an obliquely cut-off pipe unit which is arranged in the opening region of the first and second channels.

Particularly good results as far as optimum deflection of the jet, that is to say positioning against the conical opening contour, is concerned, can be achieved in that the channels open out essentially perpendicularly into the central jet channel.

In a large number of applications in the sanitary sector, the first fluid is water and the second fluid is air.

A particularly preferred configuration is distinguished in that there are provided two, three or four channels with an associated actuating element, that is to say the channels are offset circumferentially through 180°, 120° or 90°.

Further embodiments and advantages of the invention are given by the features outlined in more detail in the claims and by the exemplary embodiments specified hereinbelow. The features of the claims can be combined with one another as desired, as long as they are not obviously mutually exclusive.

BRIEF DESCRIPTION OF THE DRAWING

The invention and advantageous embodiments and developments of the same are explained and described in more detail hereinbelow with reference to the examples illustrated in the drawing. The features which can be gathered from the description and the drawing can be used, according to the invention, individually or in any desired combination. In the drawing.

METHODS OF IMPLEMENTING THE INVENTION

A nozzle device 10.1 has a nozzle body with a jet channel 14 which passes through it and has water admitted to it, as the first fluid 30, in the jet direction S. The central jet channel 14 opens out into an opening region 16 which widens in the jet direction S, that is to say the cross section of which widens conically.

Figure 2:
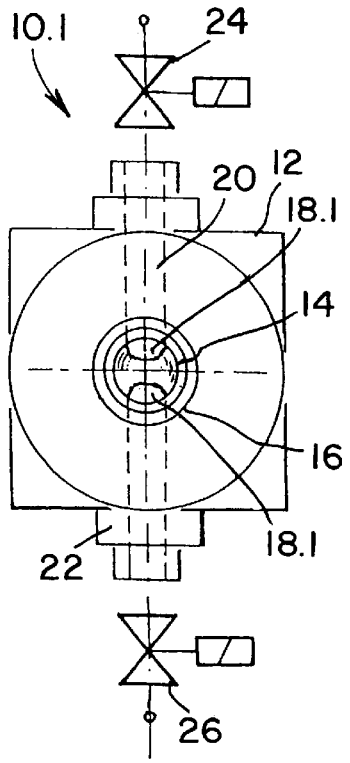
FIG. 2 shows a schematic view of the nozzle device according to FIG. 1 as seen in the direction counter to the flow direction.

A first channel 20, in which it is possible to feed air as the second fluid 40, opens out from above in the region of the transition of the central jet channel 14 into the opening region 16. A second channel 22, in which it is likewise possible to feed air as the second fluid, opens out into the central jet channel from beneath in a manner offset circumferentially through 180° (degrees) (FIG. 2). The opening region of the two channels 20, 22 is designated 17.

The two channels 20, 22 can be opened and closed in each case via an actuating element 24, 26, for example a valve unit 24 or 26, it being possible for the open and closed states of the actuating elements or valve units 24, 26 to be controlled via a control device 28, which, in the exemplary embodiment, is connected via lines 36.

In each case one constricting unit 18.1 is formed upstream, as seen in the jet direction S, of the region 17 in which the first channel 20 and the second channel 22 open out into the central jet channel 14, said constricting unit being designed as an insert plate and extending partially into the interior of the central jet channel 14, with the result that a constriction in cross section is achieved.

The constriction takes place directly upstream of the location at which the channels 20, 22 open out into the opening region 17.

In specific terms, the following operations take place. In the nozzle body 12, the channel 14 has water admitted to it in the jet direction S. Once the constricting units 18.1, which act more or less as break-away edges, have been reached, there is an increase in the flow speed in the region between the constricting units 18.1. The resulting negative pressure downstream of the constricting units 18.1 draws air into the water jet via the first and second channels 20, 22. With the valves 24, 26 open, the water/air mixture is then moved in the central jet direction S and also emerges in this direction.

A change in jet direction is achieved by alternate opening and closing of the actuating elements or valve units 24, 26. The change in direction takes place in arrow direction A1 if the valve unit 24 is open and the valve unit 26 is closed and in arrow direction A2 if the valve unit 26 is open and the valve unit 24 is closed. In both cases, the air deflects the jet in the respective direction A1 or A2, with the result that the jet is positioned against the wall of the conically widening opening region. In this case, the water jet covers the opening angle 32. The constricting unit 18.1 is preferably designed, such that it can be installed in a releasable manner, as an annular disc with projection units. By using constricting units of different sizes in each case, it is possible to vary the opening angle of the emerging water jet. Furthermore, the conical opening region may be formed by a component which can be installed in a releasable manner, with the result that it is possible to use a water jet in the opening region with a different opening angle in each case.

Figure 1:
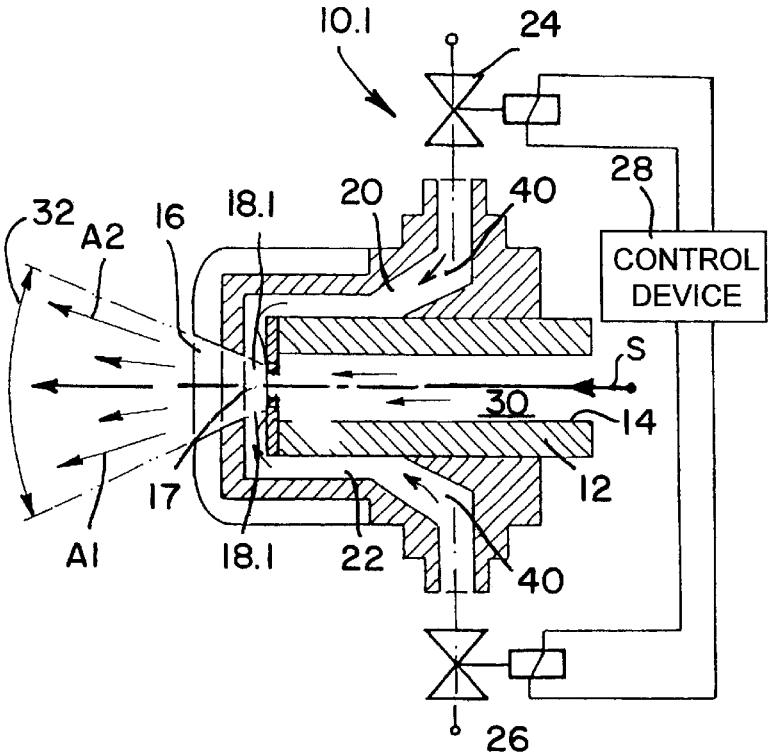
FIG. 1 shows a schematic section through a first exemplary embodiment of a nozzle device with two channels and with the direction of the discharged jet alternating.

The connection of the valves 24 and 26 of the two channels 20 and 22, respectively, to the second fluid source is illustrated in highly schematic form in the figures and designated 34. The connection of the central jet channel 14 to the source of the first fluid is intended to be depicted schematically in FIG. 1 by the arrow S. In a variant which is not illustrated, the constricting unit is part of a pipe unit which is cut off obliquely on one end side and is arranged in the opening region of the respective channel. In this case, the pipe unit is arranged such that its longer side is arranged upstream of the shorter side, as seen in the jet direction.

Figure 3:
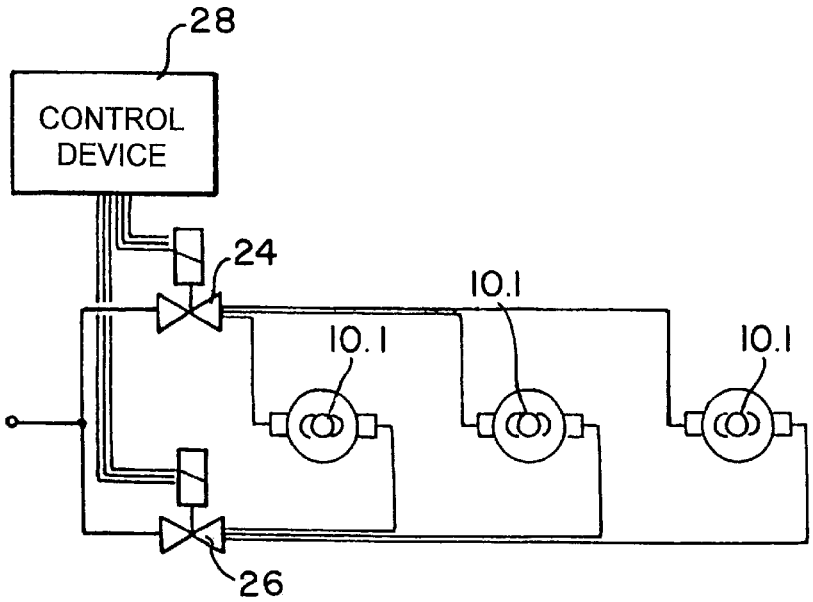
FIG. 3 shows a schematic diagram of the activation of a group of three nozzle devices each with two channels.

FIG. 3 shows a schematic diagram of a group of three nozzle devices 10.1 which can be activated individually, in groups or in parallel. The control device 28 is responsible for the activation and can be adjusted in dependence on the user.

Figure 4:
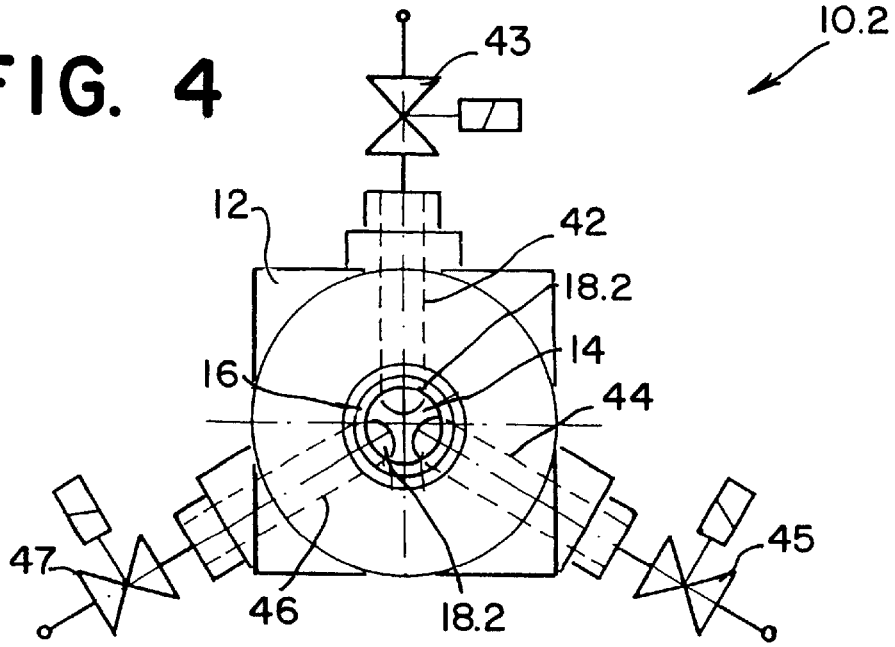
FIG. 4 shows a schematic view, as seen in the direction counter to the flow direction, of a second exemplary embodiment of a nozzle device with three channels.

FIG. 4 illustrates schematically a second exemplary embodiment of a nozzle device 10.2 which, in terms of basic construction, is of virtually identical construction to the abovedescribed nozzle device 10.2, but has three channels 42, 44, 46 which are offset through 1200 in the circumferential direction and each have associated valve units 43, 45, 47.

Figure 5:
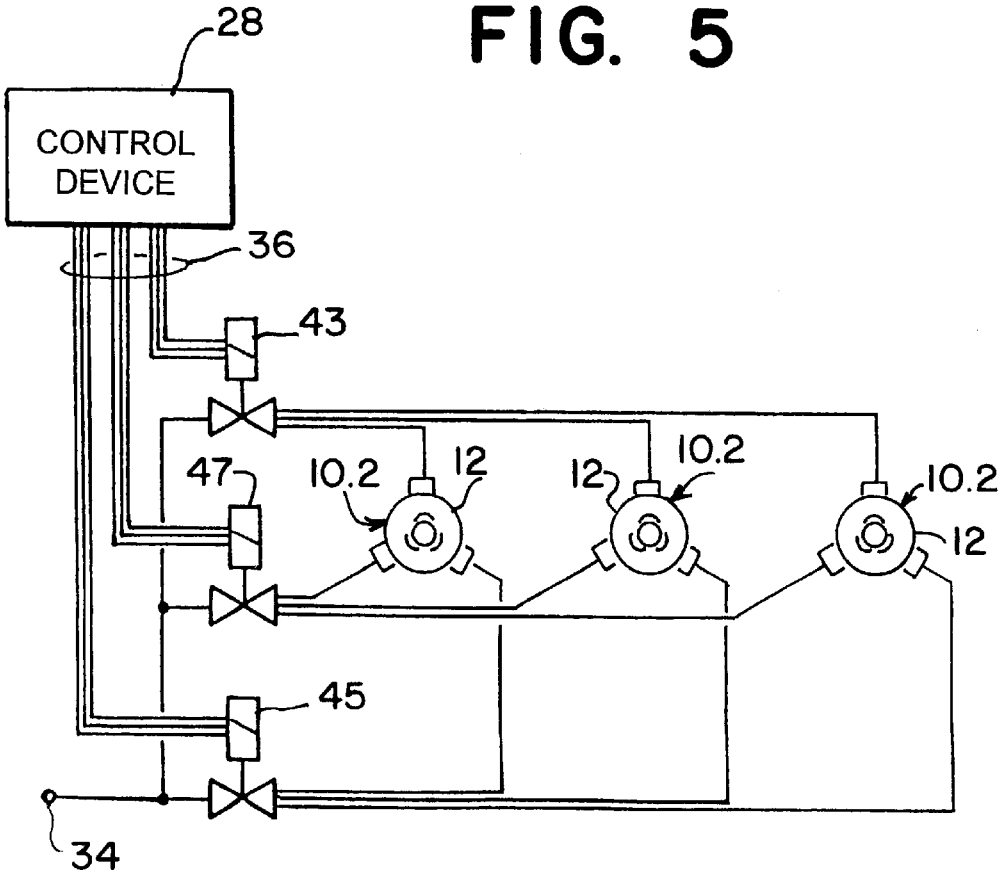
FIG. 5 shows a schematic diagram of the activation of a group of three nozzle devices each with three channels.

FIG. 5 shows, schematically, a diagram of a group of three nozzle devices 10.2 which can be activated individually, in groups or in parallel.

Figure 6:
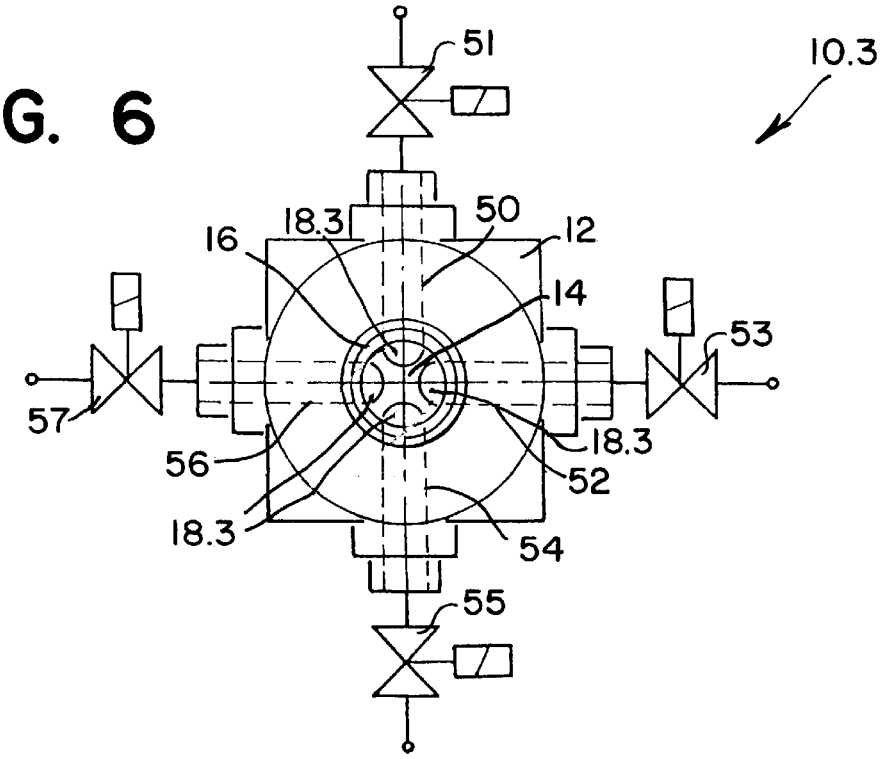
FIG. 6 shows a schematic view, as seen in the direction counter to the flow direction, of a nozzle device with four channels.

FIG. 6 illustrates a third variant of a nozzle device 10.3, this differing from the abovedescribed exemplary embodiments in that there is provided a total of four channels 50, 52, 54, 56 which are offset through 90° in the circumferential direction and each have an associated valve unit 51, 53, 55, 57.

Figure 7:
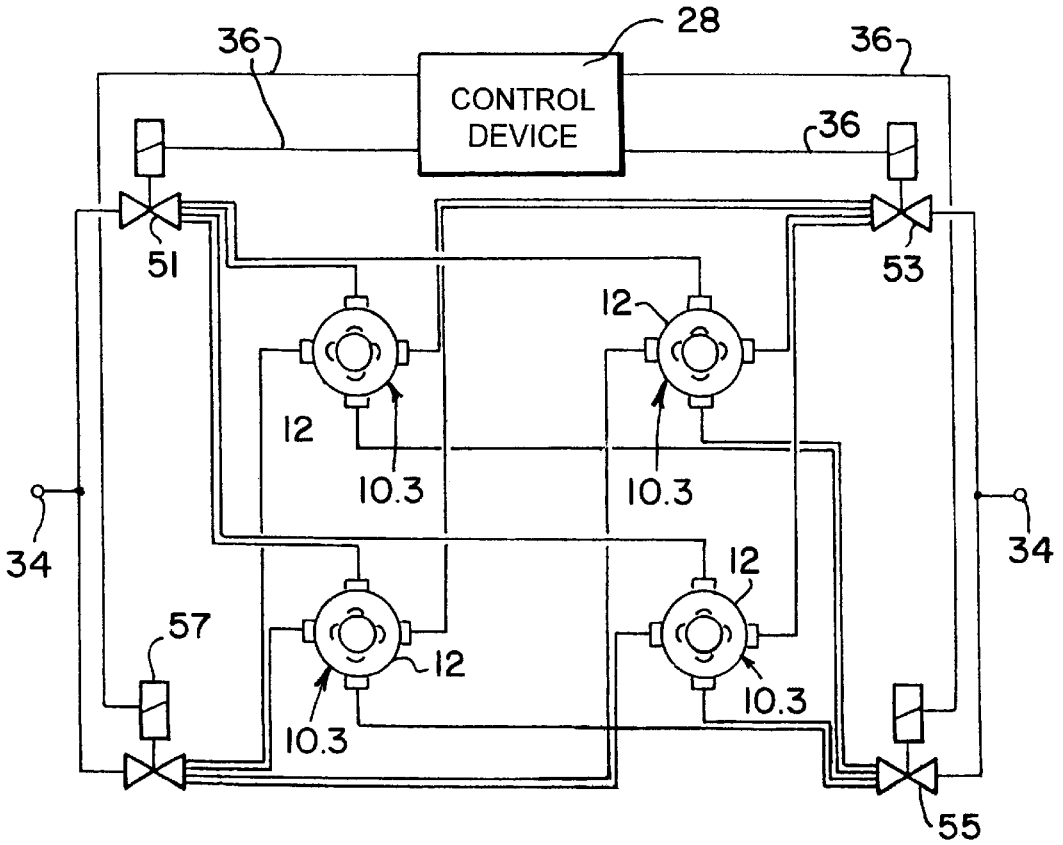
FIG. 7 shows a schematic diagram of the activation of a group of four nozzle devices each with four channels.

FIG. 7 shows, schematically, a diagram of a group of four nozzle devices 10.3 which can be activated individually, in groups or in parallel.

The activation of the valves for opening and closing purposes may also take place such that the opening and closing cycles have a predeterminable rhythm which can be influenced or determined, for example, by a predeterminable melody of a piece of music.

I claim:

1. Nozzle device for massaging and/or cleaning purposes comprising:

a nozzle body, a central jet channel, which has a first fluid admitted to the central jet channel, an opening region, which widens conically in the jet direction (S) and from which the jet channel extends, and at least two further channels, which open out into the jet channel and via which a second fluid can be fed to the first fluid, wherein the at least two channels open out into the jet channel in a transition region between the jet channel and the conical opening region, wherein respective opening regions of the at least two channels open out into the jet channel in a manner in which they are offset circumferentially through 360°/n (degrees), wherein n is equal to the number of further channels and is greater than or equal to 2, wherein in each case one constricting unit is arranged directly upstream, as seen in the jet direction (S), of the opening region in which the at least two channels open out into the jet channel, each of the at least two channels being designed such that each channel can be opened and closed via a corresponding actuating element, and there is provided a control device which activates the actuating element such that each actuating element will open and close alternatively or one after the other in circular sequence or in accordance with a predetermined rhythm.

2. Nozzle device according to claim 1, wherein the constricting unit comprises an insert plate.

3. Nozzle device according to claim 2, wherein the insert plate is configured to be installed in a releasable manner.

4. Nozzle device according to claim 1, wherein the constricting unit is part of an obliquely cut-off pipe unit which is arranged in each case in the jet channel, in the opening region of the channels.

5. Nozzle device according to claim 1, wherein the at least two channels open out perpendicularly into the central jet channel.

6. Nozzle device according to claim 1, wherein the first fluid is water and the second fluid is one of gas and air.

7. Nozzle device according to claim 1, wherein the conical opening region is formed by a component which can be installed in a releasable manner.

8. Nozzle device according to claim 1, wherein the at least two channels comprises one of two, three, and four channels with an associated actuating element.

9. Nozzle device according to claim 1, wherein the actuating element for each channel can be actuated in accordance with the rhythm of a predetermined piece of music.

10. Nozzle device according to claim 1, wherein the nozzle device is arranged in one of a sanitary water basin and a container.

11. Nozzle device according to claim 1, wherein each of the actuating elements is a valve unit.

* * * * *